United States Patent [19]

Shima

[11] Patent Number: 4,957,378

[45] Date of Patent: Sep. 18, 1990

[54] PRINTING-PLATE PREPARATION APPARATUS EMPLOYED IN SCREEN PRINTING MACHINE INCLUDING A NON-ADHESIVE PLATEN SURFACE AND A MANUSCRIPT READING UNIT.

[75] Inventor: Masayuki Shima, Sendai, Japan

[73] Assignee: Ricoh Company, Ltd., Tokyo, Japan

[21] Appl. No.: 262,270

[22] Filed: Oct. 21, 1988

Related U.S. Application Data

[63] Continuation of Ser. No. 92,574, Sep. 1, 1987, abandoned.

[30] Foreign Application Priority Data

Sep. 9, 1986 [JP] Japan ..... 61-138680

[51] Int. Cl.[5] ..... B41J 3/24

[52] U.S. Cl. ..... 400/120; 400/136; 400/641; 400/662; 101/128.4; 29/132

[58] Field of Search ..... 400/120, 136, 641, 649, 400/652, 661, 661.1, 661.4, 662, 659; 29/132; 101/128.4; 346/76 PH

[56] References Cited

U.S. PATENT DOCUMENTS

| | | | |
|---|---|---|---|
| 1,642,271 | 9/1927 | Smith | 400/649 |
| 2,699,736 | 1/1955 | Sticelber | 29/132 X |
| 3,449,548 | 6/1969 | Adamek et al. | 29/132 X |
| 3,481,805 | 12/1969 | Holmes et al. | 29/132 X |
| 3,731,358 | 5/1973 | Artl | 29/132 |
| 4,056,183 | 11/1977 | Beery | 400/649 X |
| 4,372,246 | 2/1983 | Azar et al. | 29/132 X |
| 4,522,866 | 6/1985 | Nishikawa et al. | 29/132 X |
| 4,568,951 | 2/1986 | Hasegawa et al. | 346/76 PH |
| 4,597,829 | 7/1986 | Sato et al. | 101/128.4 X |

FOREIGN PATENT DOCUMENTS

| | | | |
|---|---|---|---|
| 3025104 | 1/1982 | Fed. Rep. of Germany | 400/641 |
| 0000164 | 1/1981 | Japan | 101/128.4 |
| 0083455 | 5/1982 | Japan | 400/649 |
| 0102789 | 6/1983 | Japan | 400/649 |
| 0112797 | 7/1983 | Japan | 101/128.4 |
| 0153697 | 9/1983 | Japan | 101/128.4 |
| 0054582 | 3/1984 | Japan | 400/662 |
| 0013551 | 1/1985 | Japan | 400/120 |
| 0048398 | 3/1985 | Japan | 101/128.4 |
| 0087095 | 5/1985 | Japan | 400/136 |
| 0147338 | 8/1985 | Japan | 400/662 |
| 0154068 | 8/1985 | Japan | 101/128.4 |
| 0154069 | 8/1985 | Japan | 101/128.4 |
| 0293899 | 12/1986 | Japan | 400/136 |
| 2021596 | 1/1987 | Japan | 101/128.4 |
| 2194920 | 3/1988 | United Kingdom | 101/128.4 |

OTHER PUBLICATIONS

IBM Technical Disclosure Bulletin, "Nonstick Capstan Pinch Rolls", Denson et al. vol. 20, No. 2, Jul. 1977, pp. 710–711.

IBM Technical Disclosure Bulletin, "Hot Roll Fuser", Evans et al., vol. 24, No. 8, Jan. 1982, p. 4177.

IBM Technical Disclosure Bulletin, "Printer Platen for Band Printer", Bayer et al., vol. 25, No. 7A, Dec. 1982, p. 3521.

*Primary Examiner*—Ernest T. Wright, Jr.

*Attorney, Agent, or Firm*—Oblon, Spivak, McClelland, Maier & Neustadt

[57] ABSTRACT

In a printing-plate preparation apparatus employed in a screen printing machine comprising a thermal printhead provided with a heating-element portion, a rotatably supported platen roller for delivering a stencil paper and urging the same against a surface of the heating-element portion of the thermal printhead, and a manuscript-reading unit movable back and forth between a first position and a second position an improvement resides in that an outer peripheral surface of the platen roller is made of non-adhesive material while urged against a surface of the heating-element portion of the thermal printhead, whereby the stencil paper is clamped between the platen roller and the thermal printhead so as to be delivered while subjected to a perforation operation conducted by the heating-element portion of the thermal printhead.

7 Claims, 6 Drawing Sheets

PRINTING-PLATE PREPARATION APPARATUS EMPLOYED IN SCREEN PRINTING MACHINE INCLUDING A NON-ADHESIVE PLATEN SURFACE AND A MANUSCRIPT READING UNIT.

This application is a continuation of application Ser. No. 07/092,574, filed on Sept. 3, 1987, now abandoned.

BACKGROUND OF THE INVENTION

1. Field of the Invention:

The present invention relates to a printing-plate preparation apparatus employed in a screen printing machine in which a stencil paper is clamped between a thermal printhead and a platen roller so as to be delivered while perforated by means of a heating-element portion of the thermal printhead, and more particularly to the printing-plate preparation apparatus in which the platen roller is improved.

2. Description of the Prior Art:

The platen roller employed in the printing-plate preparation apparatus employed in the screen printing machine is provided with an outer peripheral layer made of a conventional synthetic rubber such as chloroprene rubber, nitrile rubber and the like.

As shown in FIG. 1A, in case that the outer peripheral layer 101*a* of the platen roller 101 is made of the above-mentioned conventional synthetic rubber, parts of a film layer 118 and an adhesive layer 119 of the stencil paper 105 are melted to pass through a base layer 117 of the stencil paper 105 and then adhere to the outer peripheral surface 101*a* of the platen roller 101 when the thermal printhead 102 conducts a perforation operation of the stencil paper 105, so that a deposit 120 of such parts of the stencil paper 105 is formed on the outer peripheral surface of the platen roller 101 each time the perforation operation of the stencil paper 105 is conducted by the thermal printhead 102, whereby the amount of such deposit 120 increases as the number of such perforation operations increases. The deposit 120 causes the base layer 117 of the stencil paper 105 to adhere to the outer peripheral layer 101*a* of the platen roller 101. As a result, as shown in FIG. 1B, the platen roller 101 is eventually wrapped around with the stencil paper 105 to make it impossible to deliver the printing plate or perforated stencil paper 105. This is a defect inherent in the conventional printing-plate preparation apparatus.

The thermal printhead 102 is fixedly mounted on an end portion of a bracket 103 which is swingably supported by its central axle 104 as shown in FIG. 1B. The other end portion of the bracket 103 is engaged with a machine frame 106 through a tension spring 107 for urging the thermal printhead 102 against the platen roller 101.

In a stencil paper discharging side of the platen roller 101 and the thermal printhead 102, there are provided a pair of spaced inclined guide plates 108 adjacent to which are provided a feed roller 109 and a pressure roller 110. A supporting portion 111 for the pressure roller 110 is mounted on a compression spring 112 for urging the pressure roller 110 against the feed roller 109.

On the other hand, in case that a width of the stencil paper 105 is reduced, for example, the size of the stencil paper 105 is changed from a size "B" sheet (not shown) to a size "A" (not shown) which is smaller in width than the size "B" sheet, since opposite end portions of the platen roller 101 extend outward from opposite edges of the size "A" stencil paper 105, the platen roller 101 is brought into contact with a surface of the thermal printhead 102 at its opposite end portions of the outer peripheral layer 101*a*. In this case, however, in the conventional printing-plate preparation apparatus, since the outer peripheral layer 101*a* of the platen roller 101 is made of a frictional material as described above, a large frictional resistance is produced when the platen roller 101 is brought into contact with the surface of the thermal printhead 102, so that the motor (not shown) for delivering the perforated stencil paper 105 or printing plate is overloaded. This is another defect inherent in the conventional printing-plate preparation apparatus.

OBJECT OF THE INVENTION

It is an object of the present invention to provide a printing-plate preparation apparatus employed in a screen printing machine, in which apparatus the defects inherent in the conventional printing-plate preparation apparatus are eliminated - i.e., the perforation operation of the stencil paper is conducted without fears that the platen roller is wrapped around with the stencil paper and that the motor for delivering the perforated stencil paper or printing paper is overloaded in case that the width of the stencil paper is reduced.

SUMMARY OF THE INVENTION

According to the present invention, the above object of the present invention is accomplished by providing: in a printing-plate preparation apparatus employed in a screen printing machine comprising a thermal printhead provided with a heating-element portion and a rotatably supported platen roller for delivering a stencil paper and urging the stencil paper against a surface of the heating-element portion of the thermal printhead, the improvement wherein: an outer peripheral surface of the platen roller is made of a non-adhesive material while urged against a surface of the heating-element of the thermal printhead, whereby the stencil paper is clamped between the platen roller and the thermal printhead so as to be delivered while subjected to a perforation operation conducted by the heating-element portion of said thermal printhead. Since, in the printing-plate preparation apparatus employed in the screen printing machine of the present invention, the outer peripheral surface of the platen roller is made of the non-adhesive material, there is no fear that parts of a film layer and an adhesive layer of the stencil paper adhere to the outer peripheral surface of the platen roller when melted and brought into contact with the outer peripheral surface of the platen roller during the perforation operation of the stencil paper conducted by the heating-element portion of the thermal printhead, to make it sure to prevent the platen roller from being wrapped around with the stencil paper. In addition, in the apparatus of the present invention, in case that the stencil paper is reduced in its width, the motor for delivering the perforated stencil paper or printing paper is prevented from being overloaded, because the frictional resistance produced when the opposite end portions of the platen roller are brought into contact with the surface of the heating-element portion of the thermal printhead is kept small due to the low frictional coefficient of the outer peripheral surface of the platen roller.

DESCRIPTION OF THE PREFERRED EMBODIMENTS

Hereinbelow will be described a printing-plate preparation apparatus employed in a screen printing machine of the present invention with reference to the drawings.

Figure 2:
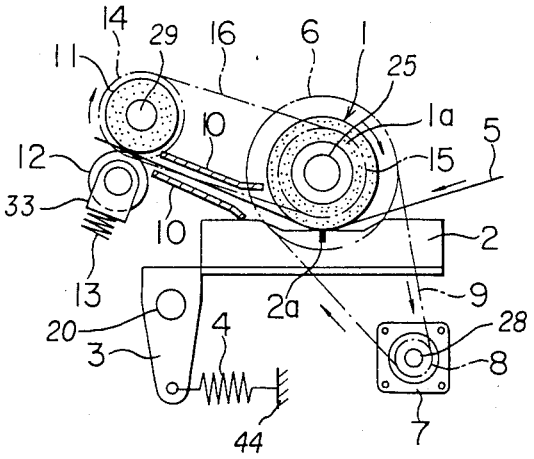
FIG. 2 is a side view of a first embodiment of the printing-plate preparation apparatus employed in the screen printing machine of the present invention.

In FIG. 2, the reference numeral 1 denotes a platen roller an outer layer 1*a* of which is made of a non-adhesive elastic material such as silicone rubber, fluorinated silicone rubber (Silastic LS) and the like. The platen roller 1 is rotatably so supported by suitable bearings (not shown) that it is brought into contact with a heating-element portion 2*a* of a thermal printhead 2 which is fixedly mounted on an end portion of a bracket 3 which is swingably supported by its central axle 20 as shown in FIG. 2. The other end portion of the bracket, 3 is engaged with a machine frame 44 through a tension spring 4 for urging the thermal printhead 2 against the platen roller 1.

The reference numeral 5 denotes a stencil paper which is clamped between the platen roller 1 and the thermal printhead 2 urged against the platen roller 1 by means of the tension spring 4 while being transferred. In this condition, the stencil paper 5 is subjected to a perforation operation thereof conducted by the heating-element portion 2*a* of the thermal printhead 2.

A pulley 6 is fixedly mounted on a rotary shaft 25 of the platen roller 1. A pulley 8 is fixedly mounted on a rotary shaft 28 of a driving motor 7. An endless belt 9 runs around these pulleys 5 and 8.

In a stencil paper discharging side of the platen roller 1 and the thermal printhead 2, there are provided a pair of spaced inclined guide plates 10 adjacent to which are provided a feed roller 11 and a pressure roller 12 as shown in FIG. 2. A supporting portion 33 for the pressure roller 12 is mounted on a compression spring 13 for urging the pressure roller 12 against the feed roller 11. A pulley 14 is fixedly mounted on a rotary shaft 29 of the feed roller 11. A pulley 15 is fixedly mounted on the rotary shaft 25 of the platen roller 1. An endless belt 16 runs around these pulleys 14 and 15.

Figure 3:
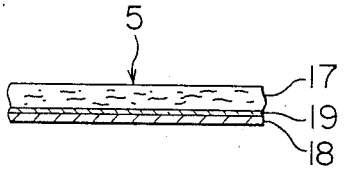
FIG. 3 is an enlarged sectional view of the stencil paper employed in the printing-plate preparation apparatus shown in FIG. 2.

As shown in FIG. 3, the stencil paper 5 is constructed of: a base layer 17 of a water-proof Japanese paper having a thickness of 40 microns; a film layer 18 made of polyester a thickness of which is within a range of from about 1.5 to 2.0 microns; and an adhesive layer 19 made of vinyl acetate, chlorinated polypropylene and like adhesives for bonding the film layer 18 to the base layer 17 of the stencil paper 5 in a lamination fashion. The stencil paper 5 is so arranged that the film layer 18 thereof is brought into contact with the heating-element portion 2*a* of the thermal printhead 2 when delivered by the platen roller 1.

In a condition in which the stencil paper 5 is clamped between the platen roller 1 and the thermal printhead 2 and delivered therethrough during its perforation operation, the heating-element portion 2*a* of the thermal printhead 2 is selectively energized so that parts of the film layer 18 and the adhesive layer 19 of the stencil paper 5 positions of which parts correspond to that of the heating-element portion 2*a* are melted to shrink so as to form pores at the above parts of stencil paper 5. At this time, the thus melted parts of the stencil paper 5 are forced to penetrate the base layer 17 of the stencil paper 5 under the impressions exerted by the platen roller 1 and the thermal printhead 2. On the other hand, since the base layer 17 having a thickness of about 40 microns is considerably thin and is coarse in structure, the thus forced melt of the stencil paper 5 having penetrated the base layer 17 thereof is brought into contact with the outer peripheral layer 1*a* of the platen roller 1. However, such melt of the stencil paper 5 is prevented from adhering to the outer peripheral layer 1*a* of the platen roller 1, because the outer peripheral layer 1*a* of the platen roller 1 is made of non-adhesive material, so that there is no fear that the platen roller 1 is wrapped around with the perforated stencil paper 5.

In addition, since the outer peripheral layer 1*a* of the platen roller 1 is made of non-adhesive material, the frictional resistance produced between the outer peripheral layer 1*a* of the platen roller 1 and the surface of the thermal printhead 2 at a time when the platen roller 1 rotates is small. Consequently, even in case that the stencil paper 5 is smaller in width than the outer peripheral layer 1*a* of the platen roller 1 (for example, when the stencil paper 5 to be delivered by a platen roller 1 is changed in size from a size "B" sheet to a size "A" sheet, which is smaller in width than the size "B" sheet), since such frictional resistance produced between the outer peripheral layer 1*a* of the platen roller 1 and the surface of the thermal printhead 2 is small as described above, the driving motor 7 for rotatably driving the platen roller 1 employed in the printing-plate preparation apparatus of the present invention is prevented from being overloaded, in contrast with a motor for rotatably driving the conventional platen roller 101 an outer layer 101*a* of which is made of a conventional synthetic rubber such as chloroprene rubber and the like having a considerably large frictional coefficient employed in the conventional printing-plate preparation apparatus.

Figure 4:
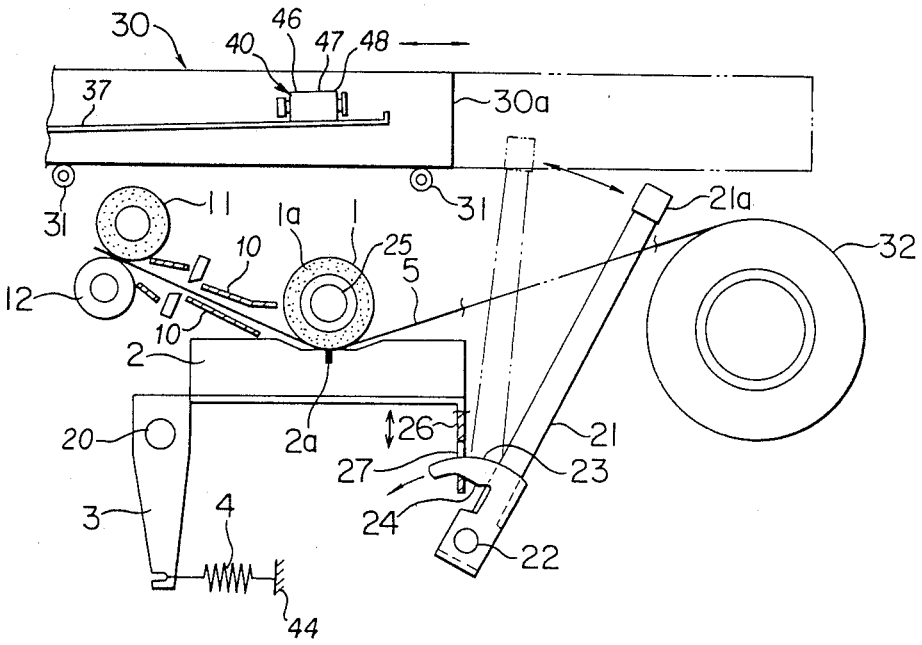
FIG. 4 is a side view of a pressure-release mechanism of the platen roller.

A pressure-release mechanism of the platen roller 1 is shown in FIG. 4, in which: the reference numeral 21 denotes a pressure-release lever which is so swingably mounted on a supporting axle 22 that its free end 21*a* is brought into contact with a manuscript-reading unit 30 during swinging movement thereof. An arc-shaped projecting member 23 is fixedly mounted on the pressure-release lever 21 at a position in the vicinity of the supporting axle 22. An upper portion of the projecting member 23 is formed into a cam portion 24. As shown in FIG. 4, an end portion of the bracket 3 is bent downward to form a downward projection 26 provided with an opening 27. When the pressure-release lever 21 is swung counter-clockwise as shown in FIG. 4 in phantom, the cam portion 24 of the arc-shaped projecting member 23 is inserted into the opening 27 of the downward projection 26 of the bracket 3 to force the downward projection 26 to move downward so that the bracket 3 is swung around its central axle 20 clockwise against a resilient force exerted by the tension spring 4, whereby the thermal printhead 2 mounted on the bracket 3 is separated from the platen roller 1.

The manuscript-reading unit 30 is guided by a pair of rollers 31 so as to reciprocate between its left position indicated in FIG. 4 in solid lines (hereinafter referred to as the solid-line position) to its right position indicated in phantom lines (hereinafter referred to as the phantom-line position). The reference numeral 32 denotes a reel of the blank stencil paper 5.

In the pressure-release mechanism of the printing-plate preparation apparatus of the present invention having the above construction, in case that a whole reel 32 of the blank stencil paper 5 is consumed, the thus consumed reel 32 should be changed for a new reel 32 of the blank stencil paper 5. In this case, as shown in FIG. 4, the manuscript-reading unit 30 is moved leftward to the solid-line position so as to make it possible to change the consumed reel 32 of the stencil paper 5 for a new one 32. After that, the pressure-release lever 21 is swingably moved to its leftward position indicated in phantom lines, so that the cam portion 24 of the arc-shaped projecting member 23 is forcibly inserted into the opening 27 of the downward projection 26 of the bracket 3 to cause the downward projection 26 to move downward, whereby the bracket 3 is forcibly swung around its central axle 20 clockwise against the resilient force exerted by the tension spring 4 to separate the thermal printhead 2 from the platen roller 1, which leads to a release of an impression exerted by the thermal printhead 2 on the platen roller 1. After completion of such release of the impression exerted on the platen roller 1, the consumed reel 32 of the stencil paper 5 is changed for a new one. After a leading end portion of the stencil paper 5 of the new reel 32 thereof has been set in the screen printing machine and is so positioned that it rests on the thermal printhead 2, the pressure-release lever 21 is swingably moved to its right position indicated in solid lines as shown in FIG. 4. As a result, the cam portion 24 of the arc-shaped projecting member 23 is disengaged from the opening 27 of the downward projection 26 of the bracket 3 so that the bracket 3 is swung around is central axle 20 counter-clockwise to cause the thermal printhead 2 to be urged against the platen roller 1 under the force exerted by the tension spring 4. At this time, the manuscript-reading unit 30 is returned to its right position indicated in phantom lines as shown in FIG. 4, so that the changing operation of the reel 32 of the stencil paper 5 is completed. In this case, even if the machine operator forgets to move the pressure-release lever 21 rightward, the thermal printhead 2 is automatically urged against the platen roller 1 under the influence of the resilient force of the tension spring 4 when the manuscript-reading unit 30 is moved rightward, because an end portion 30*a* of the manuscript-reading unit 30 pushes the free end portion 21*a* of the pressure-release lever 21 rightward to swing the pressure-release lever 21 around the supporting axle 22 clock-wise when the manuscript-reading unit 30 is moved rightward, whereby the cam portion 24 of the arc-shaped projecting member 23 is disengaged from the opening 27 of the downward projection 26 of the bracket 3 to permit the bracket 3 to swing around its central axle 20 counter-clockwise under the influence of the resilient force of the tension spring 4 so as to urge the thermal printhead 2 against the platen roller 1.

Figure 5:
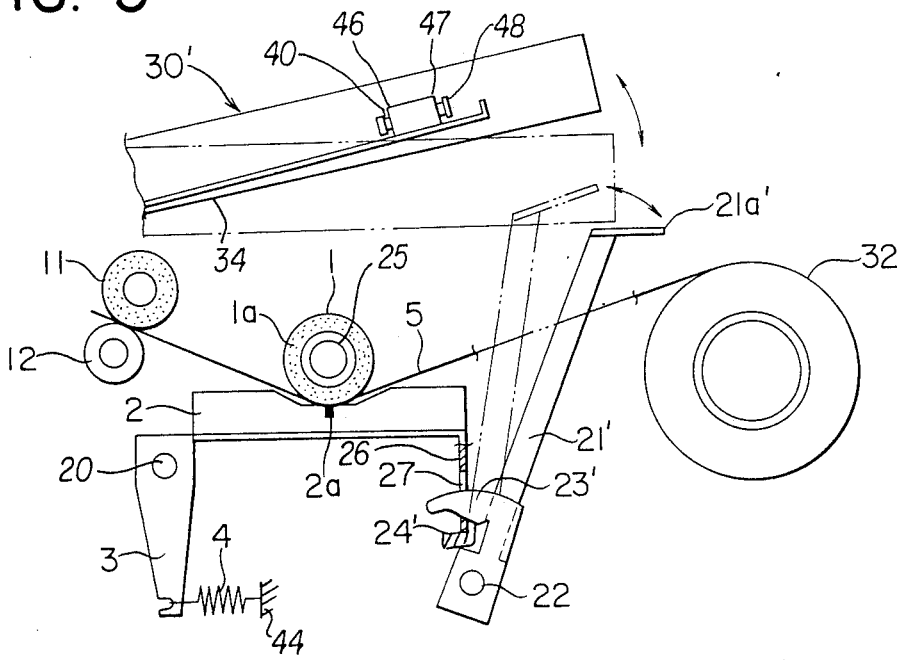
FIG. 5 is a side view of a modification of the pressure-release mechanism of the platen roller.

A modification of the printing-plate preparation apparatus of the present invention shown in FIG. 4 is shown in FIG. 5, in which the manuscript-reading unit 30' is swingably arranged in a vertical direction. In this modification shown in FIG. 5, when the manuscript reading unit 30' is moved downward, the pressure-release lever 21' is pushed at its free end portion 21*a'* by the manuscript-reading unit 30' to be turned clockwise, so that the opening 27 of the downward projection 26 of the bracket 3 is disengaged from the cam portion 24' of the arc-shaped projecting member 23' to cause the thermal printhead 2 to be urged against the platen roller 1 under the influence of the resilient force of the tension spring 4. The remaining construction of the modification shown in FIG. 5 is the same as that of the printing-plate preparation apparatus shown in FIG. 4.

Now, the manuscript reading unit 30 employed in the printing-plate preparation apparatus of the present invention will be described in detail with reference to FIGS. 6 to 9.

Figure 7:
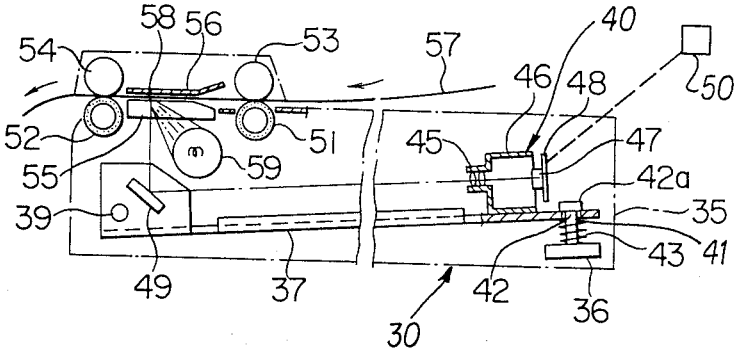
FIG. 7 is a side view of the box portion of the manuscript reading unit shown in FIG. 6.

In the drawings: the reference numeral 35 denotes a box of the manuscript reading unit 30; 36 a structural member disposed in the box 35; and 37 a base member which is swingably mounted on a shaft 39 opposite end portions 34 of which pass through through-holes 38 provided in opposite side plate portions of the base member 37 and opposite sides of the box 35 so that the shaft 39 is mounted in the box 35. On the other hand, a swinging end portion of the base member 37 is provided with a through-hole 41 which loosely receives a pin 42 embedded in the structural member 36. A suitable stopper means 42*a* such as an enlarged head portion or a stopper ring is provided in an upper portion of the pin 42 for preventing the swinging end portion of the base member 37 from disengaging from the pin 42. A compression spring 43 is mounted on the pin 42 between the structural member 36 and the base member 37 to urge the base member 37 upward relative to the structural member 36. As shown in FIG. 7, an optical assembly 40 constructed of: a lens block 46 provided with optical lenses 45; and a charge-coupled device (CCD) base 48 provided with a CCD 47 is fixedly mounted on the base member 37 at a position in the vicinity of the through-hole 41. In addition, a plane mirror 49 is fixedly mounted on the side plate portion of the base member 37 at a position in the vicinity of the through-holes 38.

In FIG. 7: the reference numerals 51 and 52 denote manuscript-feed rollers which are rotatably driven by a suitable driving member (not shown); 53 and 54 denote pressure rollers urged against the manuscript-feed rollers 51 and 52 respectively under the influence of the resilient forces of compression springs 74, 75 (shown in FIG. 10); 55 denotes a contact glass; and 56 denotes a guide plate. A manuscript 57 delivered by the rollers 51, 53 is guided by the guide plate 56 to a manuscript-reading portion 58 of the contact glass 55 and then to the rollers 52, 54. A light source 59 illuminates the manuscript 57 through the manuscript-reading portion 58 of the contact glass 55 to project beams which are reflected by the plane mirror 49 and pass through the optical lenses 45 to form an image of the manuscript 57 on the CCD 47 of the optical assembly 40. The CCD 47 transforms an optical signal of such image into an electrical signal which is issued to a recording portion 50 of the printing-plate preparation apparatus of the present invention, while the manuscript 57 having been recorded in the recording portion 50 in the form of the electrical signal is further delivered by the rollers 52, 54 so as to be discharged from the box 35.

Figure 6:
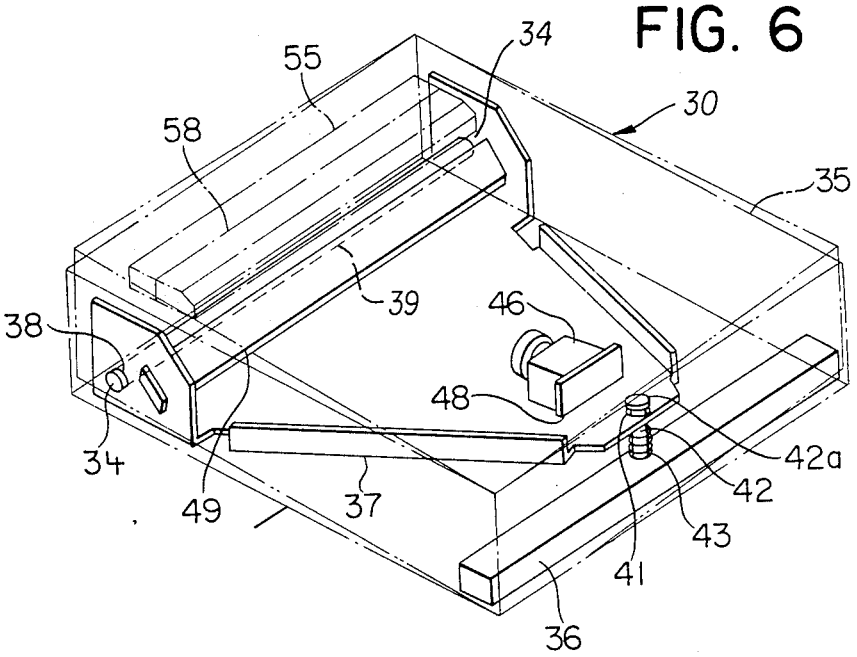
FIG. 6 is a perspective view of a box portion of a manuscript reading unit.
Figure 8A:
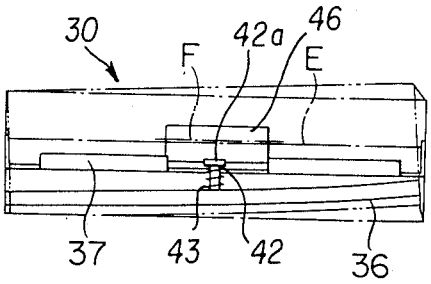
FIGS. 8A and 8B are front views of the box portion of the manuscript reading unit shown in FIG. 6, for illustrating operation of the box portion.
Figure 8B:
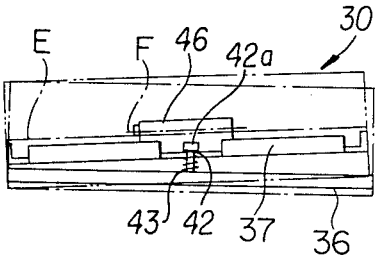

In this case, even if the box 35 is poor in rigidity so that the box 35 is deformed as shown in FIGS. 6 and 8B in phantom, an image deflection on the plane mirror 49 is negligible, because the shaft 39 passing through the base member 37 also inclines according to the deformation of the box 35 to cause the base member 37 to incline to the same extent as that of the shaft 39 which corresponds to the deformation of the box 35.

In this connection, even if the box 35 is deformed as shown in FIGS. 6 and 8A in phantom so that the structural member 36 is inclined, the image deflection on the plate mirror 49 is also negligible (i.e., an angle formed between a line F on the CCD 47 and an image-reading position line E is negligible), because the base member 37 is kept free from the inclination of the structural member 36 due to a clearance provided between the base member 37 and the structural member 36 and the deformable compression spring 43 provided therebetween.

Figure 9:
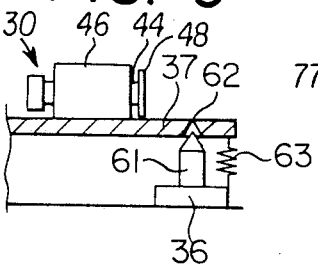
FIG. 9 is a partial side view of a modification of a positioning unit of a base member relative to the box portion of the manuscript reading unit shown in FIG. 6.

In place of the pin 42, it is also possible to employ a pin 61 (see FIG. 9) an upper end portion of which is shaped into a cone. The pin 61 is embedded into the structural member 36 as shown in FIG. 9, while the base member 37 is provided with a concave portion 62 for receiving the conical upper end portion of pin 61 therein. In this case, the base member 37 is urged against the structural member 36 under the influence of the resilient force of a tension spring 63 as shown in FIG. 9 so that the same effect as that of the above embodiments employing the pin 41 and the compression spring 43 is obtained.

Figure 10:
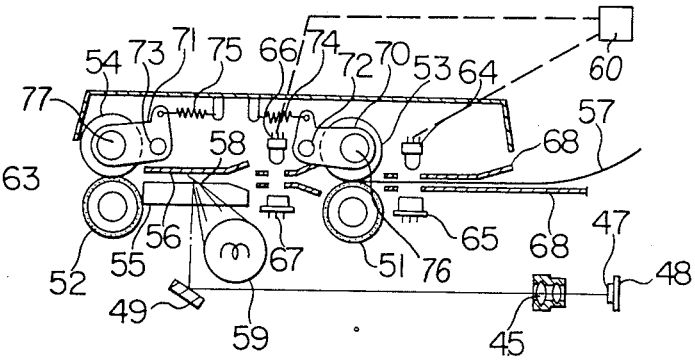
FIG. 10 is an enlarged side view of the manuscript reading unit shown in FIG. 7.

As for the manuscript-reading unit 30, as shown in FIG. 10, it is provided with the following mechanism for facilitating setting and positioning operations of the manuscript 57.

In this mechanism shown in FIG. 10: the reference numerals 64, 65 and 66, 67 denote pairs of vertically-arranged sensors for detecting a leading end portion of the manuscript 57 being delivered, respectively; 68 denotes a pair of vertically-arranged guide plates; 70 and 71 denote arms swingably mounted on central axles 72 and 73 respectively, end portions of which arms 70 and 71 are mounted on rotary shafts 76, 77 of the pressure rollers 53 and 54, respectively; and 74 and 75 denote compression springs mounted between the box 35 and the other end portions of the arms 70 and 71 respectively to urge the pressure rollers 53 and 54 against the manuscript-feed rollers 51 and 52, respectively.

In operation, the leading end portion of the manuscript 57 is inserted between the manuscript-feed roller 51 and the pressure roller 53 through the guide plates 68. The thus inserted leading end portion of the manuscript 57 passing through the sensors 64, 65 as shown in FIG. 10 after passing through the guide plates 68, to cause the sensors 64, 65 to issue a detection signal to a control unit 60 of the printing-plate preparation apparatus of the present invention. Such control unit 60 issues a driving-start signal with a predetermined time-lag, for example a lag of from 0.2 to 1 second after it receives the detection signal, which driving-start signal causes the manuscript feed roller 51 to be rotatably driven to feed the manuscript 57 clamped between the manuscript-feed roller 51 and the pressure roller 53. When the leading end portion of the manuscript 57 passes through the sensors 66, 67, the sensors 66, 67 issue a detection signal to the control unit 60 which in turn issues a driving-stop signal with a predetermined time-lag after its receives the detection signal issued from the sensors 66, 67. The driving-stop signal is received by the driving members so that the delivery of the manuscript 57 is stopped, whereby the manuscript 57 is set in a condition in which the leading end portion thereof is set at a predetermined position in the manuscript-reading unit 30.

As described above, the leading end portion of the manuscript 57 is firmly clamped between the rollers 51 and 53 so that a front edge of the leading end portion of the manuscript 57 is aligned with a line parallel to axial lines of the rollers 51, 53 to ensure a correct orientation of the manuscript 57. Accordingly, the manuscript-reading unit 30 shown in FIG. 10 is easy in operation, and it enables the machine operator to surely set the manuscript 57 in a predetermined position, so that it is excellent in operability.

Incidentally, although the manuscript-reading unit 30 is described in the above as a unit employed in the printing-plate preparation apparatus of the screen printing machine, it is also possible to employ the manuscript-reading unit 30 in copiers and facsimile apparatuses.

Figure 1A:
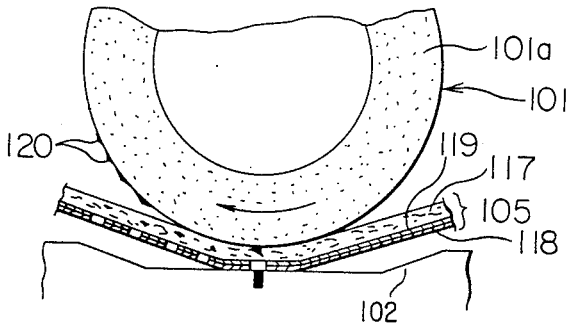
FIG. 1A PRIOR ART
FIG. 1A is a partially enlarged side view of the platen roller of the conventional printing-plate preparation apparatus employed in the screen printing machine.
Figure 1B:
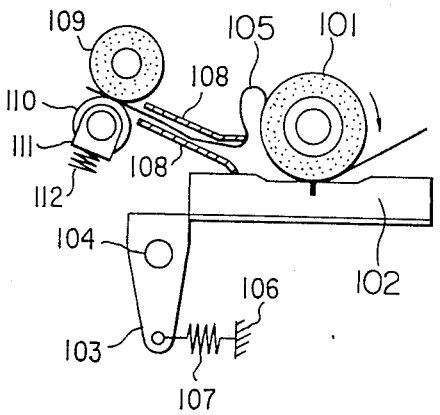
FIG. 1B PRIOR ART
FIG. 1B is a side view of the conventional printing-plate preparation apparatus shown in FIG. 1A, for illustrating an operation of the apparatus.
Figure 11:
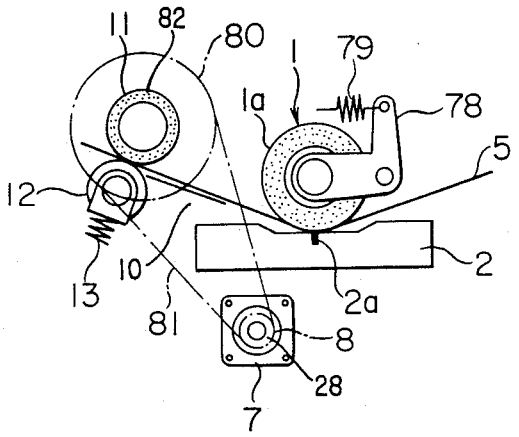
FIG. 11 is a side view of a second embodiment of the printing-plate preparation apparatus employed in the screen printing machine of the present invention.

A second embodiment of the present invention is shown in FIG. 11, in which the platen roller 1 is not driven while urged against the thermal printhead 2 under the influence of a resilient force of a tension spring 79 mounted between the box 35 and an end portion of an arm 78. In this case, the thermal printhead 2 is held stationary. A pulley 80 is fixedly mounted on a rotary shaft 82 of the feed roller 11. The pulley 8 is fixedly mounted on the rotary shaft 28 of the driving motor 7. An endless belt 81 runs around these pulleys 80 and 8 so that the feed roller 11 is rotatably driven to deliver the stencil 5. The remaining construction such as the outer peripheral layer 1*a* of the platen roller 1 of the second embodiment shown in FIG. 11 is the same as that of the first embodiment shown in FIGS. 1 and 2.

Figure 12:
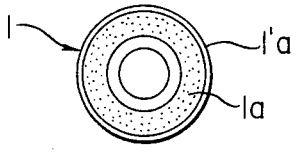
FIG. 12 is a side view of the platen roller employed in a third embodiment of the printing-plate preparation apparatus employed in the screen printing machine of the present invention.

A third embodiment of the present invention is shown in FIG. 12, in which the outer peripheral layer 1*a'* of the platen roller 1 is made of a conventional elastic material such as the conventional synthetic rubber in contrast with the first and second embodiments of the present invention employing the non-adhesive elastic material in the outer peripheral layer 1a of the platen roller 1 thereof, provided that an outer peripheral surface of the outer peripheral layer 1a' of the platen roller 1 of the third embodiment forms an outer peripheral surface layer 1a' made of a non-adhesive material such as Teflon and the like. The platen roller 1 having the above construction has the same effect as that employed in the first and second embodiments of the present invention in preventing the platen roller 1 from being wrapped around with the perforated stencil paper 5.

Figure 13:
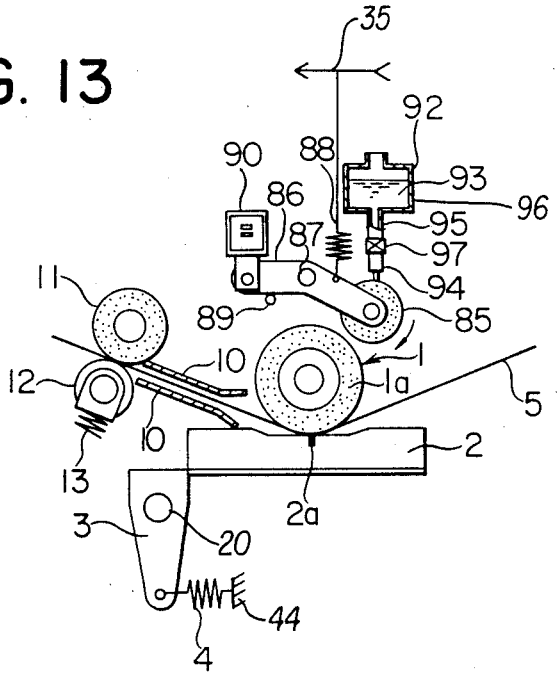
FIG. 13 is a side view of a fourth embodiment of the printing-plate preparation apparatus employed in the screen printing machine of the present invention.

A fourth embodiment of the present invention is shown in FIG. 13, in which the outer peripheral layer 1a'' of the platen roller 1 is made of an oil-resistant elastic material, for example such as a synthetic rubber comprising: nitrile rubber; urethane rubber; acrylic rubber; fluorinated silicone rubber; silicone rubber; and the like. In FIG. 13, the reference numeral 85 denotes a roller made of the same material as that of the outer peripheral layer 1a'' of the platen roller 1. The roller 85 is rotatably mounted on an end portion of an arm 86 which is swingably supported by a central axle 87. A tension spring 88 is mounted between the box 35 and the arm 86 as shown in FIG. 13 to urge the roller 85 away from the platen roller 1. The reference numeral 89 denotes a stopper for stopping the arm 86. A suitable actuator such as a solenoid 90 and the like is connected to the other end portion of the arm 86. When the solenoid 90 is actuated, the arm 86 is forcibly swung around the central axle 87 clockwise so that the roller 85 is urged against the platen roller 1. An oil reservoir 92 is provided above the roller 85, in which reservoir 92 is received a mineral oil 93 such as silicon oil and the like. The bottom portion 96 of the oil reservoir 92 is connected with an oil pipe 95 which is provided with an oil-dropping opening 94 at its lowest end portion and a valve or a pump 97 at its intermediate portion for dropping the oil 93 by an adequate amount.

In preparation of the printing plate, the solenoid 90 is actuated to urge the roller 85 against the platen roller 1, so that the roller 85 is rotatably driven by the platen roller 1. At this time, the valve or pump 97 provided in the intermediate portion of the oil pipe 95 is operated to permit the oil 93 to drop from the oil-dropping opening 94 to the outer peripheral surface of the roller 85. The oil 93 having dropped onto the roller 85 is then transferred to the outer peripheral surface of the platen roller 1 to form a thin oil layer thereon. Under such circumstances, the preparation of the printing plate is conducted, in which preparation the thus transferred oil 93 is interposed between the base layer 17 of the stencil paper 5 and the outer peripheral surface of the platen roller 1 to prevent the melted parts of both the film layer 18 and the adhesive layer 19 from adhering to the outer peripheral surface of the platen roller 1, so that the platen roller 1 is prevented from being wrapped around with the perforated stencil paper 5.

Figure 14:
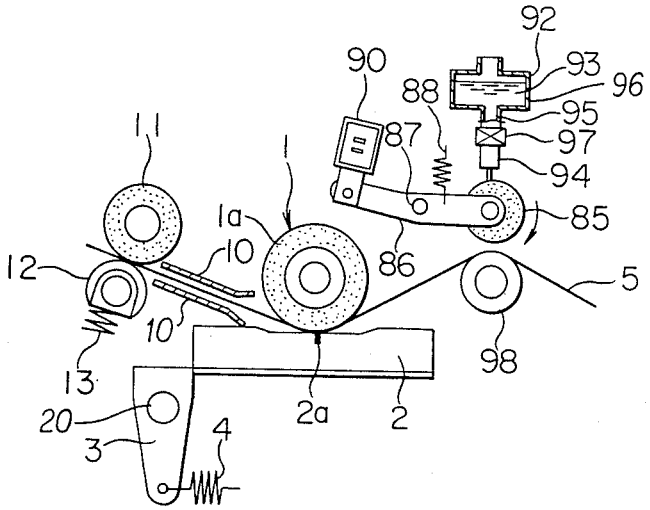
FIG. 14 is a side view of a fifth embodiment of the printing-plate preparation apparatus employed in the screen printing machine of the present invention.

A fifth embodiment of the present invention is shown in FIG. 14, which fifth embodiment is different from the fourth embodiment in that the roller 85 is separated from the platen roller 1 while disposed in a position above a stencil paper feed roller 98 with which the roller 85 is brought into contact at a time when the solenoid 90 is actuated.

Since the fifth embodiment of the present invention has the above construction, in case that the stencil paper 5 is delivered so as to pass through the rollers 85 and 98, when the solenoid 90 is actuated in the preparation of the printing plate or perforation operation of the stencil paper 5, the roller 85 is urged against the roller 98 through the stencil paper 5 so that the oil 93 is transferred from the roller 85 to the base layer 17 of the stencil paper 5 by an adequate amount. When the thus oiled stencil paper 5 with the oil 93 is subjected to the printing-plate preparation operation or perforation operation of the stencil paper 5, the same effect as that obtained in the fourth embodiment of the present invention is obtained. Namely, since the oil 93 is interposed between the outer peripheral surface of the platen roller 1 and the base layer 17 of the stencil paper 5, the melted parts of the film layer 18 and the adhesive layer 19 of the stencil paper 5 are prevented from adhering the outer peripheral surface 1a of the platen roller 1, whereby the platen roller 1 is prevented from being wrapped around with the perforated stencil paper 5.

What is claimed is:

1. A printing-plate preparation apparatus comprising:

(a) a platen roller an outer layer of which is made of a non-adhesive elastic material;

(b) a thermal printhead positioned so that, said thermal printhead can be brought into operative association with said platen roller;

(c) a bracket swingably supported on a first axle, said thermal printhead being mounted on said bracket and said bracket being swingable back and forth between a first position in which said thermal printhead is operatively associated with said platen roller and a second position;

(d) means for biasing said thermal printhead towards operative association with said platen roller;

(e) a manuscript-reading unit movable back and forth between a first position and a second position; and (f) a pressure-release lever swingably mounted on a second axle for movement back and forth between a first position and a second position, said pressure-release lever:

(i) being linked to said bracket so that, when said pressure-release lever moves from its first position to its second position, said bracket moves from its first position to its second position, and (ii) having a portion that protrudes into the path of said manuscript-reading unit such that, as said manuscript-reading unit moves from its first position to its second position, said portion contacts said pressure-release lever, causing said pressure-release lever to move from its second position to its first position.

2. A printing-plate preparation apparatus as recited in claim 1 wherein said pressure-release lever is linked to said bracket by means of:

(a) an opening in said bracket and (b) an arc-shaped projecting member on said pressure-release lever that is received in said opening, said arc-shaped projecting member having a cam portion that bears against said bracket causing movement of said bracket as said pressure-release lever moves.

3. A printing-plate preparation apparatus as recited in claim 1 wherein the motion of said manuscript-reading unit is linear.

4. A printing-plate preparation apparatus as recited in claim 1 wherein the motion of said manuscript-reading unit is pivotal.

5. A printing-plate preparation apparatus as recited in claim 1 wherein said bracket is shaped as a bell crank having two arms, on one of which said thermal printhead is mounted and against the other of which said means for biasing acts.

6. A printing-plate preparation apparatus comprising:

(a) a platen roller an outer layer of which is made of a non-adhesive elastic material;

(b) a thermal printhead positioned so that said thermal printhead can be brought into operative association with said platen roller;

(c) a reel of stencil paper which is in juxtaposition with said platen roller and with said thermal printhead, a portion of said stencil paper being clutched between said platen roller and said thermal printhead in order to be perforated and recorded while said thermal printhead is activated under the application of a signal;

(d) a manuscript-reading unit comprising:

(i) a manuscript-reading means for reading manuscript including at least at light source for exposing manuscripts, a CCD generating said signal corresponding to the manuscript, and a lens focusing a beam reflected from the manuscripts on said CCD;

(ii) a manuscript-conveying means including a pair of conveying rollers for conveying manuscripts past said manuscript-reading means, said manuscript-reading unit being movable back and forth between a first position which is able to form a space to take out a consumed reel and to replenish a new reel and a second position which is able to cover said space; and (e) means for moving said manuscript-reading unit relative to said platen roller horizontally and/or pivotably;

whereby the consumed reel is replaced by a new reel through a space made by movement of said manuscript-reading unit from its second position to its first position effected while clutching of said portion of said stencil paper between said platen roller and said thermal printhead is released.

7. A printing-plate preparation apparatus comprising:

(a) a platen roller an outer layer of which is made of a non-adhesive elastic material;

(b) a thermal printhead positioned so that said thermal printhead can be brought into operative association with said platen roller; and (c) a manuscript-reading unit comprising:

(i) a box;

(ii) a structural member disposed in said box;

(iii) a base member swingably supported on a shaft opposite ends of which are received in said box, said base member having a through-hole remote from said shaft;

(iv) a pin mounted on said structural member and received in said through-hole; (v) a compression spring disposed on said pin and bearing on said structural member and on said base member so as to urge said base member upward relative to said structural member;

(vi) a plane mirror mounted on said base member; and (vii) a CCD for reading manuscripts mounted on said base member, whereby, even if said box is deformed so that said structural member is inclined, the image deflection between said plane mirror and said CCD is negligible because said base member is kept free from the inclination of said structural member due to the clearance provided between said base member and said structural member and the effect of said compression spring.

* * * * *